US007681843B2

(12) United States Patent
McQueeny

(10) Patent No.: US 7,681,843 B2
(45) Date of Patent: Mar. 23, 2010

(54) DISPLAY AND RETAINING CLIP

(75) Inventor: Thomas P. McQueeny, Chicago, IL (US)

(73) Assignee: Cambridge Silversmiths Ltd., Inc., Fairfield, NJ (US)

( * ) Notice: Subject to any disclaimer, the term of this patent is extended or adjusted under 35 U.S.C. 154(b) by 239 days.

(21) Appl. No.: 11/753,132

(22) Filed: May 24, 2007

(65) Prior Publication Data

US 2008/0290232 A1 Nov. 27, 2008

(51) Int. Cl.
*F16L 3/08* (2006.01)
*A44B 1/04* (2006.01)

(52) U.S. Cl. ..... 248/73; 24/455; 24/464; 24/485; 24/297; 248/67.7; 248/74.2; 248/222.12; 248/316.7

(58) Field of Classification Search ..... 248/68.1, 248/69, 74.1, 74.2, 74.3, 222.12, 316.7, 67.7, 248/73, 231.81; 24/295, 293, 297, 455, 458, 24/459, 462, 464, 485
See application file for complete search history.

(56) References Cited

U.S. PATENT DOCUMENTS

| | | | | |
|---|---|---|---|---|
| 1,294,522 | A | | 2/1919 | Nathan |
| 1,296,584 | A | | 3/1919 | Bicker |
| 1,576,232 | A | | 3/1926 | Cooke |
| 2,597,275 | A | | 5/1952 | Ahlstrand |
| 2,713,469 | A | | 7/1955 | Wright |
| 2,742,771 | A | | 4/1956 | Negaard |
| 3,154,281 | A | | 10/1964 | Frank |
| 3,305,100 | A | | 2/1967 | Barbee |
| 3,345,706 | A | | 10/1967 | Stokes |
| 3,931,668 | A | | 1/1976 | Hombach |
| 5,263,233 | A | * | 11/1993 | Kim et al. ..... 24/295 |
| 5,517,731 | A | * | 5/1996 | Spykerman ..... 24/295 |
| 5,722,124 | A | * | 3/1998 | Wisniewski ..... 24/295 |
| 6,071,131 | A | * | 6/2000 | Pliml, Jr. ..... 439/95 |
| 6,101,686 | A | * | 8/2000 | Velthoven et al. ..... 24/295 |
| 6,141,837 | A | * | 11/2000 | Wisniewski ..... 24/295 |
| 6,161,804 | A | * | 12/2000 | Paske et al. ..... 248/74.1 |
| 6,415,478 | B1 | * | 7/2002 | Watanabe et al. ..... 16/444 |
| 6,604,714 | B1 | | 8/2003 | Hall |
| 6,899,305 | B2 | * | 5/2005 | Korczak et al. ..... 248/68.1 |
| 6,918,162 | B2 | * | 7/2005 | Bodo ..... 24/293 |
| 7,234,209 | B2 | * | 6/2007 | Totani et al. ..... 24/607 |
| 7,399,151 | B2 | * | 7/2008 | Lubera et al. ..... 411/522 |

* cited by examiner

*Primary Examiner*—Amy J Sterling
*Assistant Examiner*—Tan Le
(74) *Attorney, Agent, or Firm*—Ladas & Parry LLP

(57) ABSTRACT

A display and mounting clip, particularly adapted to mount flatware to a display board, has a shank supporting a closed loop through which the displayed item is inserted. Opposed support arms, coupled to the shank, support the item within the loop. The shank is adapted to extend through the mounting board. Flexible locking means extend from the shank and can be placed into a splayed orientation below the mounting board to retain the clip in position.

8 Claims, 4 Drawing Sheets

DISPLAY AND RETAINING CLIP

The present invention relates to a new and improved clip for mounting an object for display purposes upon a backing board or surface.

BACKGROUND OF THE INVENTION

Purchasing decisions for many consumer items, such as tableware products, are based on the appearance of the item. A flatware manufacturer or distributor, for example, may offer a wide variety of designs or patterns, in efforts to attract customers having a wide range of tastes.

Flatware is typically sold in sets, comprising knives, dinner forks, salad forks, teaspoons and tablespoons, packaged as a service for 4, 8 or 12. Additional pieces, such as differently-sized serving pieces, such as butter knives, sugar shells, and serving forks and spoons, may also be provided.

To assist the consumer in making a pattern choice, boxed packaging for flatware service often includes a window in the top of the box, with sample pieces of the flatware displayed upon a backer board recessed behind the window. The individual flatware pieces are typically affixed to the backer board by several small, spaced lengths of wire that loop around the flatware piece handle and pass through a pair of holes in the display board, with the ends of the wire length twisted together behind the board. Such a fastening is cumbersome to install, and since the flatware handle is often curved in elevation, often fails to fully secure the piece to the display board. Similar fastenings are used with other backer board constructions, such as wall-mounted display panels or boards.

Another means for displaying the pattern pieces is by use of a clip-like device. The clip typically is in the form of a resilient U-shaped member that is firmly affixed to the display board. The handle of the flatware to be displayed is inserted between the arms of the clip and retained by their resiliency. These clips are relatively expensive and do not prevent removal of the price mounted thereon. They also must be chosen with consideration of the cross-sectional size and shape of the item to be held.

It is accordingly a purpose of the present invention to provide a display and mounting clip for objects, such as flatware items, that securely maintain the item inserted thereon.

A further purpose of the present invention is to provide a display and mounting clip that may be easily positioned upon a variety of display boards, and can be firmly and securely mounted thereon.

Yet another purpose of the present invention is to provide a display and mounting clip that can securely accommodate a variety of cross-sectional shapes.

A still further purpose of the present invention is to provide a retaining clip that is of simple and efficient construction and operation, and that is economical to manufacture.

BRIEF DESCRIPTION OF THE INVENTION

In accordance with the foregoing and other objects and purposes, the present invention is a clip that may be formed as a one-piece construction of an appropriate resilient material such as nylon or plastic. A central shank extends through a hole in the mounting board. The upper end of the shank divides into two oppositely curved support arms, the spaced ends of which form a pedestal upon which a displayed element rests. Above the display board the shank also supports the ends of an upwardly-extending loop that surrounds the pedestal, and through the interior of which the displayed and mounted item, such as a piece of flatware, is placed and which, in conjunction with the pedestal, firmly engage and support the displayed item.

The lower end of the shank supports first ends of a pair of flexible locking wings that have first and second orientations. In the first orientation, the wings lie flat against the shank, allowing the lower portion of the shank and wings to be inserted through the mounting board mounting hole. In the second orientation, the wings extend outwardly, generally perpendicular to the shank, to bear against the lower surface of the display board, retaining the display board between the wings and the upwardly-extending loop and thus retaining the clip in position on the board. The shank has locking means to retain the wings in the outward orientation.

BRIEF DESCRIPTION OF THE DRAWINGS

A fuller understanding of the present invention will be achieved upon consideration of the following detailed description of a preferred but nonetheless illustrative embodiment of the invention when reviewed in association with the annexed drawings, wherein.

DETAILED DESCRIPTION OF THE INVENTION

Figure 1:
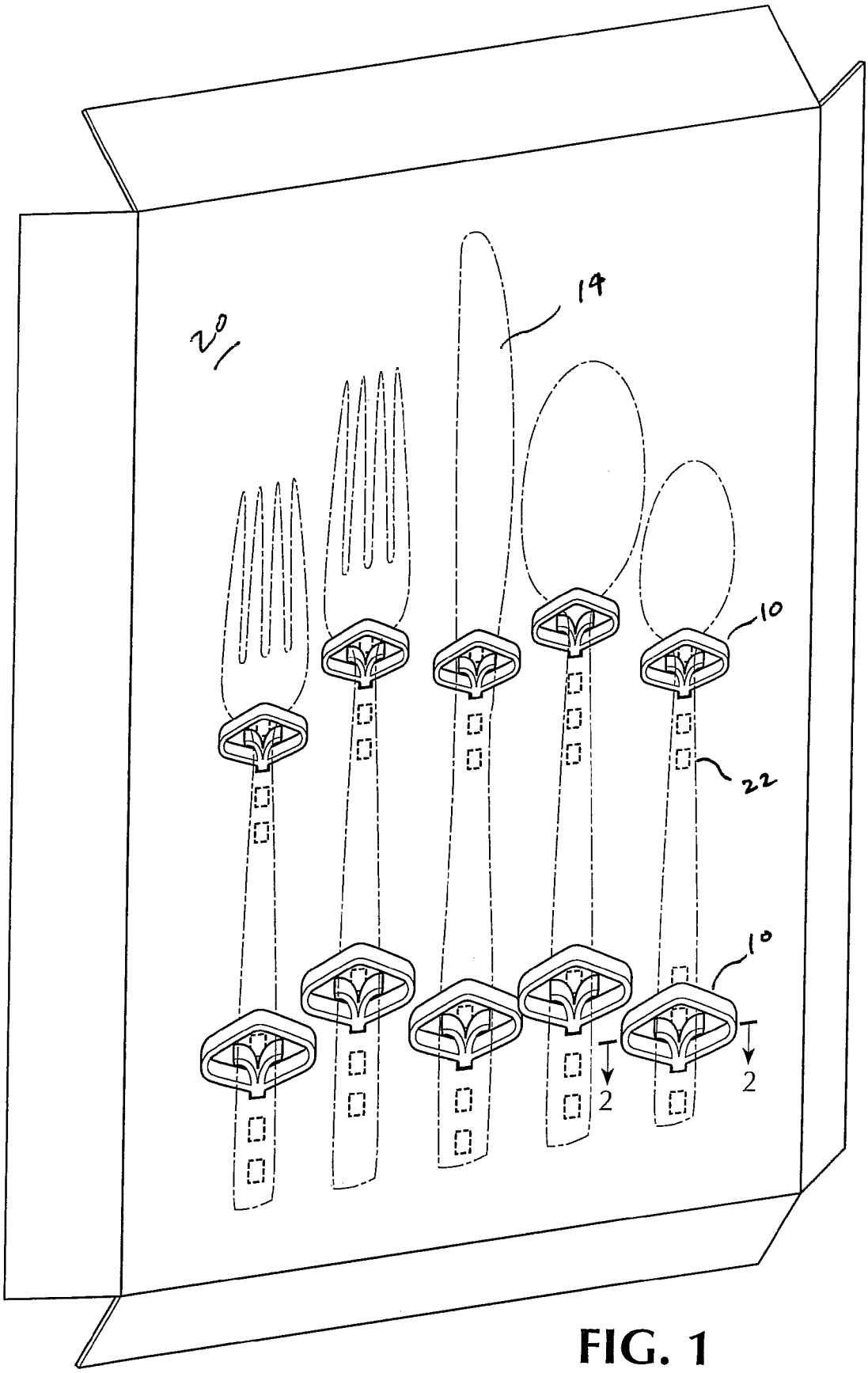
FIG. 1 is a perspective view of a series of clips shown installed on a display board in the form of a box insert, the flatware items being retained by the clips shown in phantom.
Figure 2:
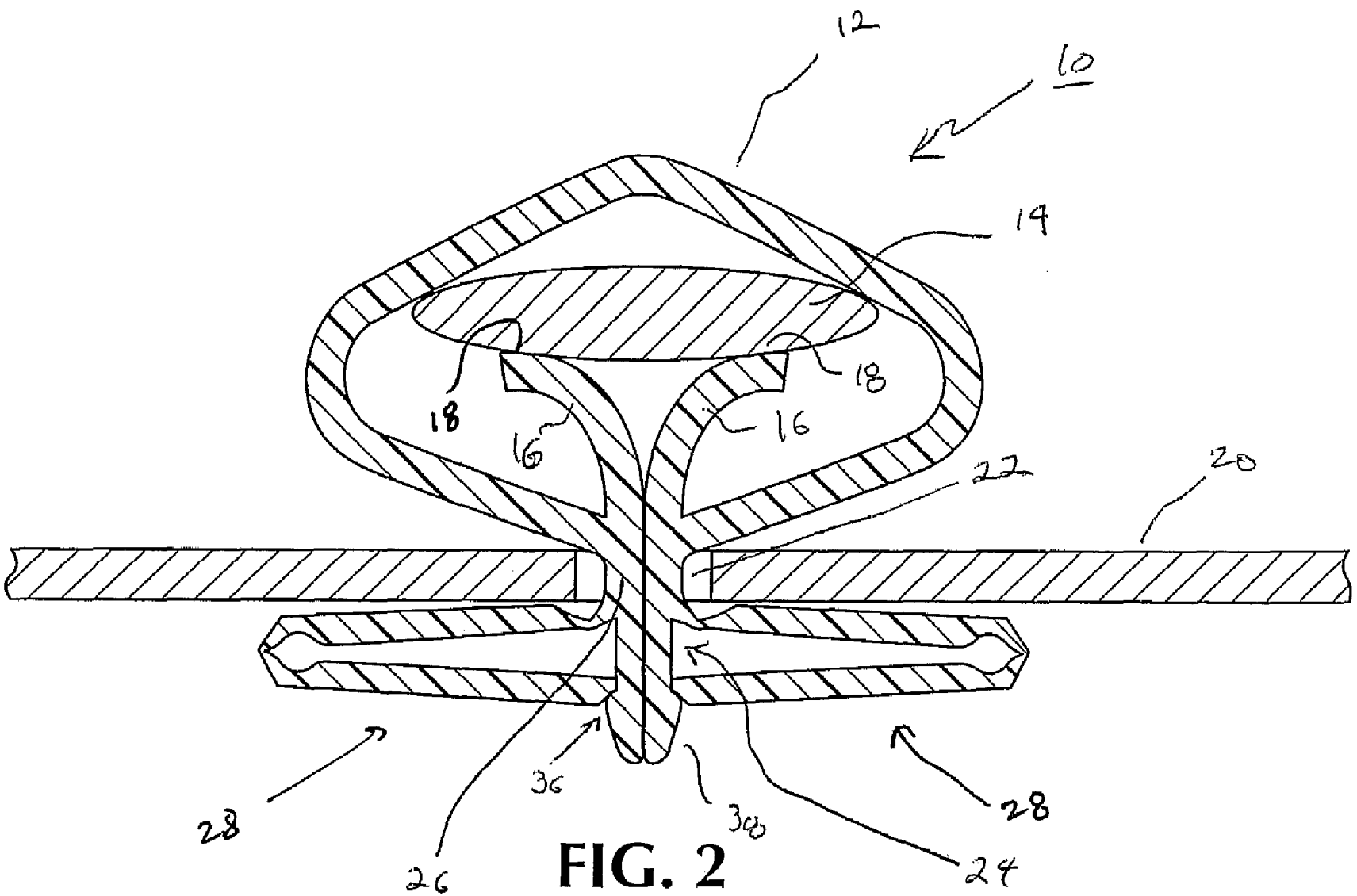
FIG. 2 is a sectional elevational view taken along line 2-2 in FIG. 1, showing a representative clip of FIG. 1 installed on the display board.

With initial reference to FIGS. 1 and 2, a clip 10 of the present invention is formed of a tough, resilient material, such as plastic, and may be constructed as a unitary cast or molded product. The clip is designed and adapted to mount on a display board 20, which may be provided with a plurality of mounting holes 22 through which the clips may be inserted and mounted to the display board. Alternatively, the display board 20 may be provided with a plurality of indicated pre-scored or weakened areas to facilitate clip insertion, a designated area being opened by the insertion action of the clip. As shown in FIG. 1, the display board may be, for example, a box insert upon which a plurality of items, such as flatware pieces 14, is mounted for display. Each piece 14 is supported by a pair of clips 10.

Clip 10 has a vertical shank 24, the central neck portion 26 of which extends through the mounting hole 22. The upper end of the shank divides into two support arms 16, which flare apart and terminate in a pair of spaced ends having contact surfaces 18 upon which the displayed piece 14 rests. The clip shank also supports the ends of an upwardly-extending item-embracing loop or band 12, through the interior of which the displayed piece 14 is inserted. When the clip is mounted on the display board 20, the support arms 16 and loop 12 engage the displayed piece 14, their resiliency providing a sure and secure grip against the piece.

Figure 4:
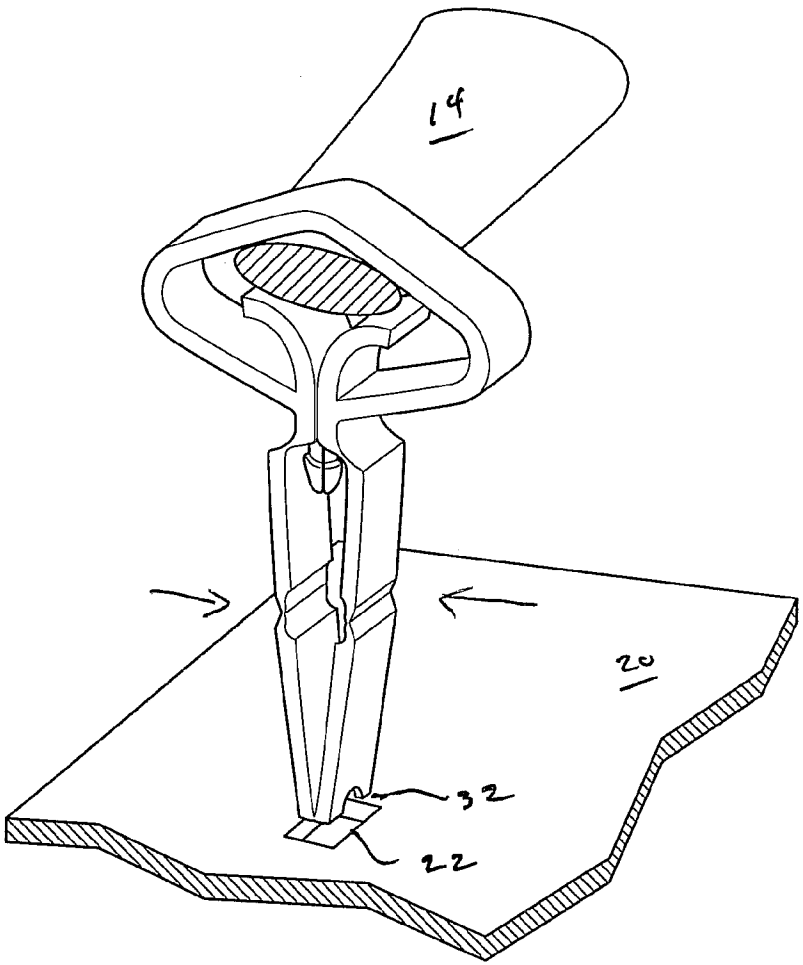
FIG. 4 is a perspective view of the clip in a second insertion step.
Figure 3:
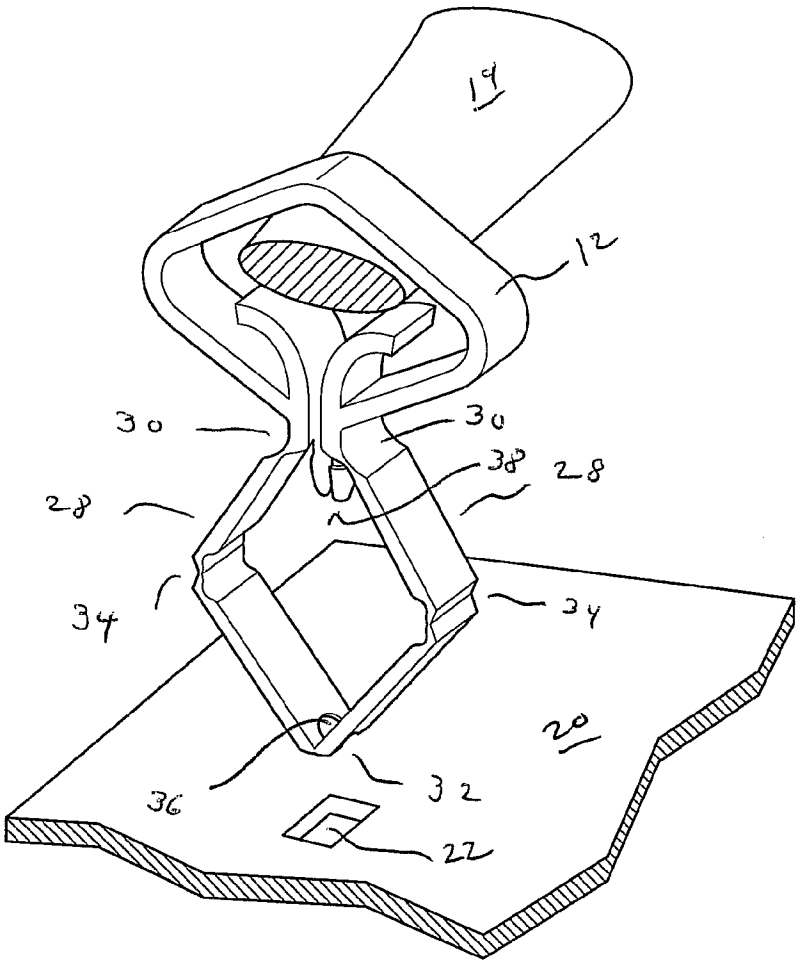
FIG. 3 is a perspective view of a clip in a first step of mounting the clip on the display board.
Figure 6:
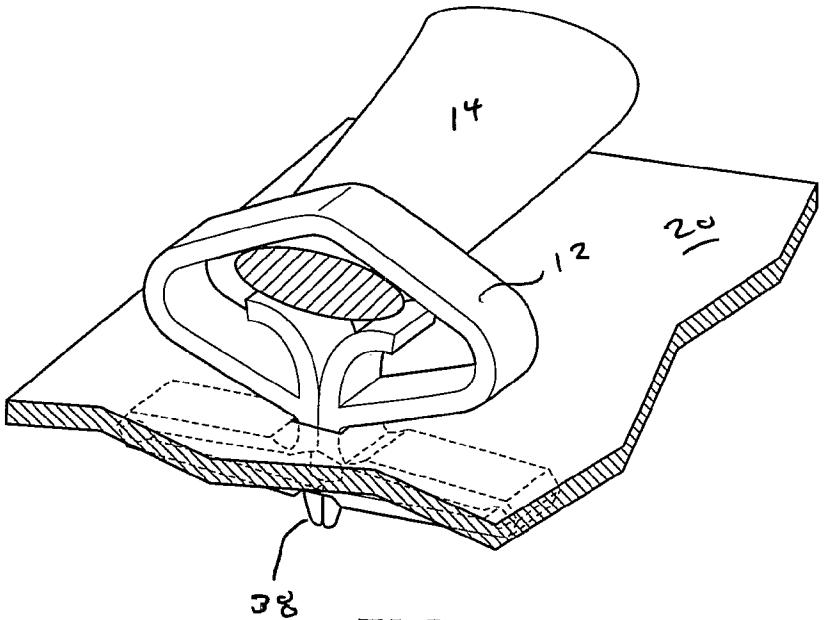
FIG. 6 is a perspective view of the clip fully installed and locked on the display board.

The lower end of shank 24 supports a pair of locking wings 28 which, as may be best seen in FIG. 3, are joined at their upper ends 30 to the shank 24 and to each other at their lower ends 32. The . . . upper ends 30, lower ends 32 and central portions 34 of the locking wings may be of a reduced thickness to allow them to flex or pivot at those locations. As may be seen in FIGS. 3-6, the flexibility of the locking wings allow them to attain a generally vertical position, abutting and parallel to the shank 24, as shown in FIG. 4, as well as a splayed, horizontal orientation as shown in FIGS. 2 and 6. The lower, joined ends 32 of the locking wings are provided with a central bore 36, which permits the wings, when in the splayed, horizontal position, to engage the lower end of shank 24, which is provided with an enlarged lower end 38 to accommodate urged passage of the aperture 36 past the end and then serves to retain the wings in the splayed position.

Utilization of the mounting clip is as follows. With reference to FIG. 3, the flatware or other object 14 to be supported by the clip is inserted within the loop 12, whereby it rests upon the ends of the support arms 16. In its initial configuration, the locking wings 28, due to the inherent elasticity of the plastic material from which the clip is formed, are typically partially splayed or separated, and define a generally diamond-shaped orientation.

As depicted in FIG. 4, the locking wings 28 are then pinched together, as depicted by the arrows, causing the wings to assume the generally parallel, vertical orientation. In such a condition the joined lower ends 32 of the arms are aligned with, and inserted through, the display board hole 22 in which the clip is to be mounted.

Figure 5:
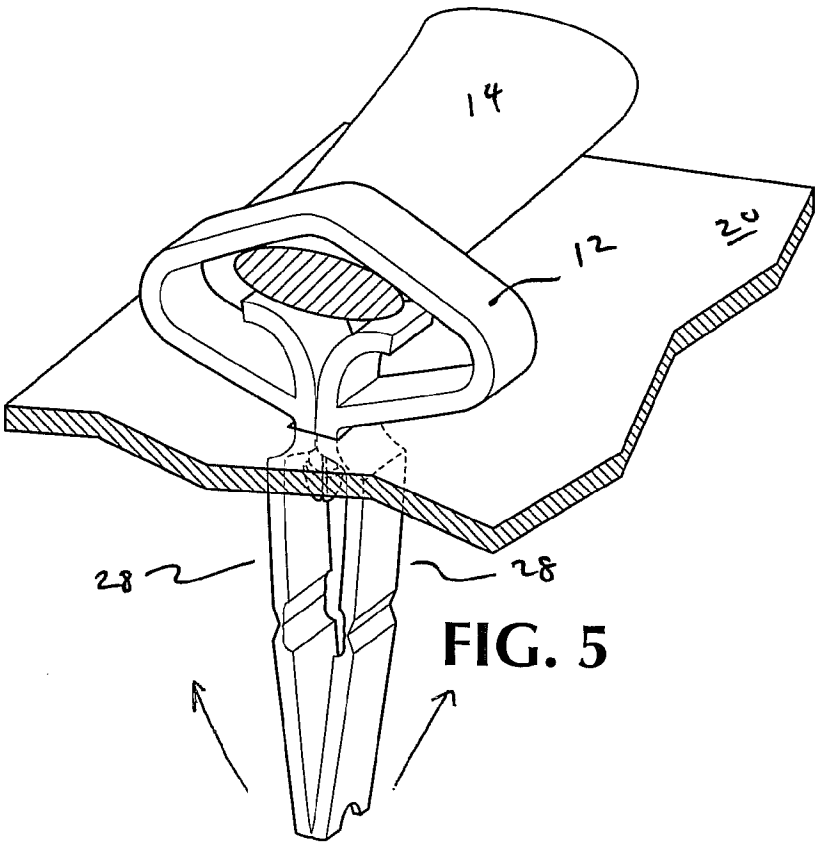
FIG. 5 is a perspective view of the clip in a third insertion step.

FIG. 5 illustrates the clip fully inserted through the mounting hole 22. The central neck portion 26 of the shank, between the lower termination points of the loop 12 and above the connection points for the upper ends of the locking wings 30, is aligned with the display board, the lower end of loop 12 abutting the top surface of the display board and the locking wings 28 extending below the lower surface thereof. So inserted, the locking wings 28 are pivoted and splayed apart into the horizontal position, as shown in FIG. 6. The wing aperture 36 engages the shank 24, and is passed upwardly over the widened end 38 of the shank, whereby the locking wings are releasably retained and secured in the outwardly splayed position. So oriented, the clip is firmly attached to the mounting board, vertical motion and removal of the clip from the board being prevented by the loop and the splayed locking arms.

Preferably, the loop 12 and arms 16 are dimensioned such that the portion of the item 14 to be inserted and retained therebetween is gently clamped between the loop and arms through flexture thereof. As shown in the Figures, shank 24 may be of a two-piece construction, each of the two pieces extending vertically, forming one of the arms 16 and supporting an end of loop 12 and an one of the locking wings 28. Such a construction further provides flexibility to the clip, allowing the clip arms 16 to be spread apart while at the same time slightly distorting the shape of loop 12 to facilitate the insertion of the flatware element 14 within the loop.

As depicted in FIG. 1, a plurality of the clips 10 may be utilized to mount an elongated item, such as a flatware piece, at two or more positions along its length. As so utilized the clip of the present invention provides a secure mounting for a flatware or other element to a backing board, preventing unintended removal of the mounted element. With access to the rear surface of the display board, however, the locking arms can be released from the shank 24 by manipulating the aperture 36 downwardly passed the widened shank end 38, allowing the locking arms to be returned to the position of FIG. 5, whereby the clip can easily be passed upwardly and out of the display board hole. The displayed item can then be removed from the clip. The clip can be reused as desired.

I claim:

1. A mounting clip for supporting an object for display with respect to a mounting board, comprising a shank, a substantially closed loop forming an enclosed aperture through which the object for display by the clip is passed supported by the shank, the enclosed aperture dimensioned to fully surround, enclose and retain a portion of the object; a pair of opposed support arms coupled to the shank at first ends thereof and extending upwardly within the enclosed aperture to engage the portion of the object within the enclosed aperture and bias the portion against an inner surface of the closed loop to retain and restrain the object; a pair of opposed flexible locking wings coupled to the shank; and locking means for retaining the locking wings in a splayed orientation for retaining the clip in engagement with the mounting board, the closed loop and flexible locking wings being positioned with respect to the shank such that they are positioned at opposed sides of the mounting board when the mounting clip is installed thereon.

2. The mounting clip of claim 1, wherein the shank has a central potion dimensioned to be aligned with a mounting hole in the mounting board.

3. The mounting clip of claim 1, wherein the support arms are constructed as upper extensions of the shank and have outwardly curved upper ends.

4. The mounting clip of claim 3, wherein the upper ends of the support arms form contact surfaces for the object.

5. The mounting clip of claim 1, wherein the support arms and loop are dimensioned to resiliently engage the object therebetween when the clip is mounted upon the mounting board.

6. The mounting clip of claim 1, wherein the locking wings are pivotally joined to the shank at first ends thereof and pivotally joined together at second ends thereof.

7. The mounting clip of claim 6, wherein the locking means comprise an enlarged lower end of the shank and an aperture at the joined second ends of the locking wings.

8. The mounting clip of claim 6, wherein the locking wings each have a central pivot point.

* * * * *